US005409437A

United States Patent [19]

Lauro et al.

[11] Patent Number: 5,409,437

[45] Date of Patent: Apr. 25, 1995

[54] INFANT WALKER

[75] Inventors: William C. Lauro, Southern Pines, N.C.; Timothy J. Banach, Twin Lakes, Wis.; Edward M. Johnson, Park Forest, Ill.

[73] Assignee: Kolcraft Enterprises, Inc., Chicago, Ill.

[21] Appl. No.: 93,910

[22] Filed: Jul. 19, 1993

[51] Int. Cl.[6] ..... A61H 3/04

[52] U.S. Cl. ..... 482/66; 482/68; 472/15

[58] Field of Search ..... 482/51, 66, 67, 68, 482/69; 148; 119/704; 472/15; 297/DIG. 11

[56] References Cited

U.S. PATENT DOCUMENTS

| | | | |
|---|---|---|---|
| 368,477 | 8/1887 | Lane et al. | 482/15 |
| 2,308,626 | 1/1943 | Reinholz | 472/15 |
| 2,862,711 | 12/1958 | Quemore, Sr. | 119/704 |

*Primary Examiner*—Stephen R. Crow

*Attorney, Agent, or Firm*—Jones, Day, Reavis & Pogue

[57] ABSTRACT

An infant walker comprising an infant carriage unit, a central anchor member including a central pivoting member, and an attachment arm connected to the infant carriage unit and releasably attached to the central pivoting member is provided for allowing an infant to walk only in a circular path about the central anchor member.

10 Claims, 4 Drawing Sheets

INFANT WALKER

BACKGROUND OF THE INVENTION

1. Field of the Invention The present invention relates to an infant walker. More particularly, it is concerned with an infant walker attached to a central anchor member wherein an infant placed in the walker is restricted to walking in a circular path about the central anchor member.

2. Description of the Related Art

Infant walkers are well known in the art and have been used for many years. They allow infants to begin learning how to walk with the aid of the walker. In addition, infants placed in a walker have much greater mobility than they would otherwise have.

Typically, infant walkers give infants virtually unrestricted mobility. This mobility allows infants to easily and quickly move across significant areas of a room or home. This increased mobility provides for a much increased chance of injury or accident involving the infant.

Accidents involving infants in walkers typically occur when the infant walks over the edge of and falls down a flight of stairs or off an elevated surface such as a deck or porch of a home. In addition, the walkers can topple over when the walker becomes caught on some low lying edge and the infant then can fall and be injured. The freedom of movement provided by the walker to the infant also allows the infant to quickly walk into dangerous situations such as into a hot oven or to an electrical outlet. When an infant is placed in a walker the chance that the child will become injured while using the walker is significant even if the infant is left unattended by a parent or guardian for only a few seconds.

In addition, a child using known walkers often becomes trapped or stuck against furniture, a wall, or other obstacle and quickly becomes frustrated because he cannot move about the room. Once a child becomes stuck, a parent or guardian must move the walker and point the infant in a direction in which the infant is able to freely walk.

SUMMARY OF THE INVENTION

It is therefore an object of the present invention to provide an infant walker which restricts the path of the walker to a known area thereby preventing the infant from wandering into a dangerous situation.

It is a further object of the present invention to provide a walker which prevents the walker from being tipped over by the infant during use of the walker.

It is still a further object of the present invention to provide the infant with a walker which restricts its path of movement so that the infant can walk unobstructed and will not become frustrated during use of the walker.

Another object of the present invention is to provide certain safety features in the walker which discourage the misuse of the walker.

The infant walker in accordance with the present invention meets these and other objects and also, in large measure, solves the problems outlined above. An infant walker comprises an infant carriage attached to a central anchor member by an attachment arm. The central anchor member includes a central pivoting member which is connected to the attachment arm and when an infant walks in the carriage the infant's path is restricted to a circular path about the anchor member.

DESCRIPTION OF THE PREFERRED EMBODIMENT

Figure 1:
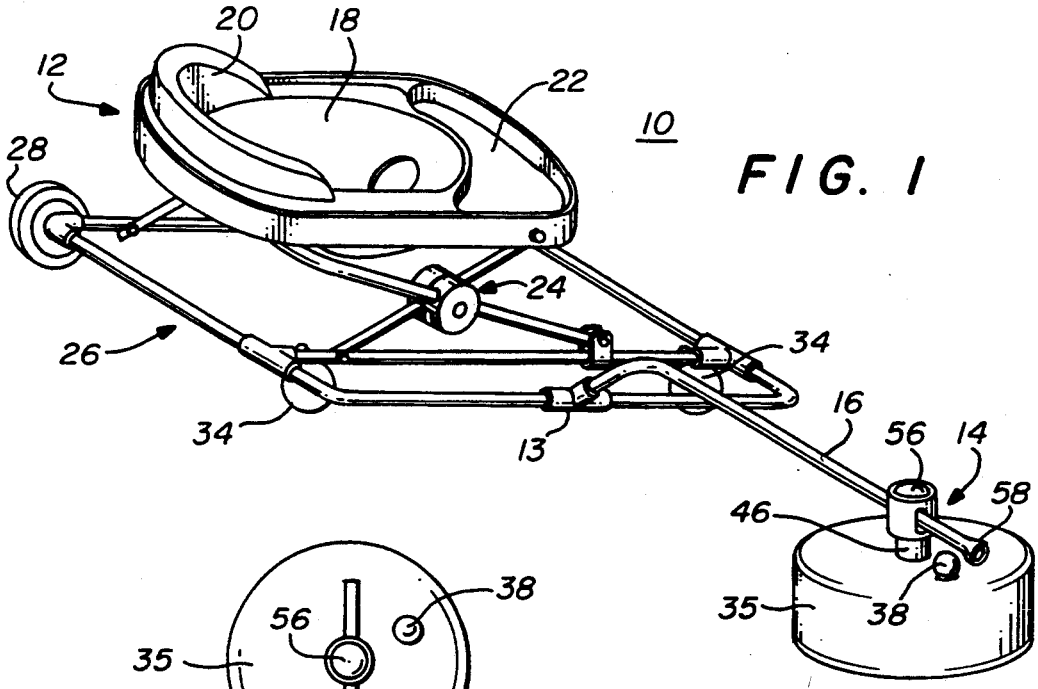
FIG. 1 is a perspective view of an infant walker in accordance with the present invention.

Referring to FIG. 1, an infant walker 10 in accordance with the invention is shown. Infant walker 10 includes an infant carriage unit 12, a central anchor member 14, and an attachment arm 16 connected to the carriage unit 12 at pivoting connection 13 and the anchor member 14.

Figure 2:
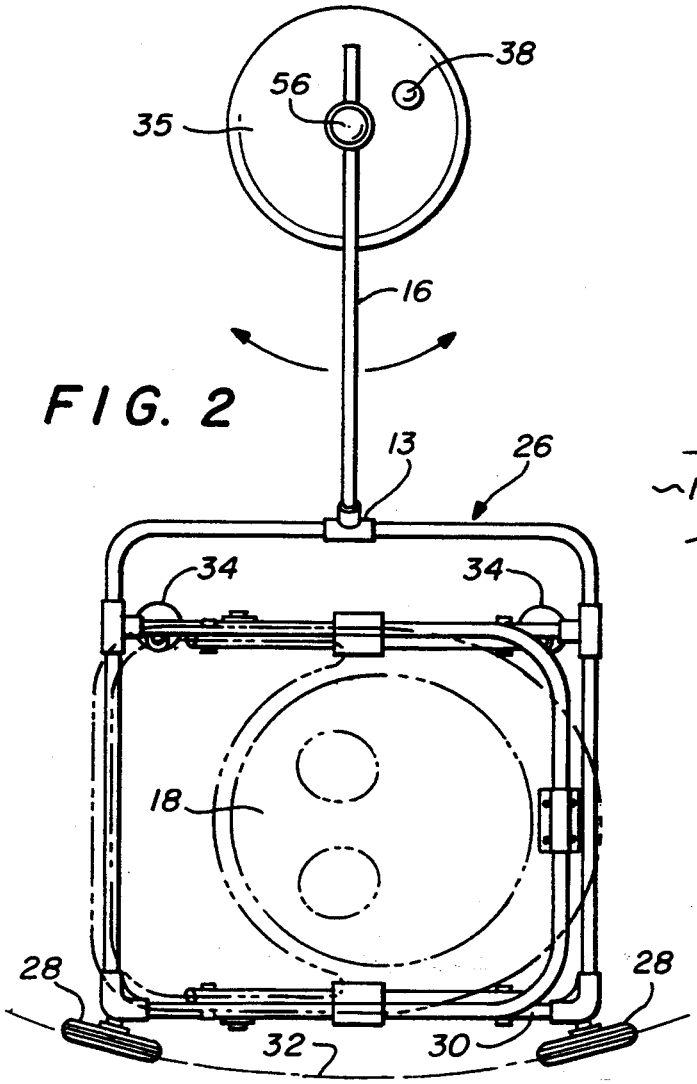
FIG. 2 is a top view of the infant walker in accordance with the present invention.
Figure 3:
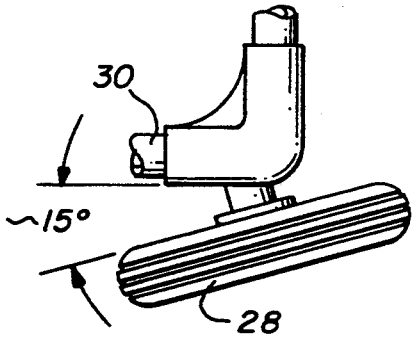
FIG. 3 is a fragmentary view of a fixed angle outside wheel of the infant walker.

The infant carriage unit 12 includes an infant seat 18, backrest 20, and tray portion 22. The infant seat 18 is supported by frame member 24 which in turn is connected to a base frame member 26. Preferably, wheels are attached to the base frame member 26, as best seen in FIGS. 2 and 3, and includes two outside wheels 28 fixedly attached at approximately 15° angles from a side portion 30 of base frame member 26. By fixedly attaching outside wheels 28 to base frame 26 so that wheels 28 lie in a common arcuate path 32 it helps ensure that infant carriage unit 12 is not easily used when detached from central anchor member 14. This is because by fixing the wheels at a preferred 15° the walker will not easily be moved in other than a circular path. Two additional wheels 34 are preferably casters attached towards the inside of infant carriage unit 12, as shown in FIGS. 1 and 2. Casters 34 are, preferably, pivotally mounted to base frame member 26 and provide added support to carriage unit 12.

Figure 4:
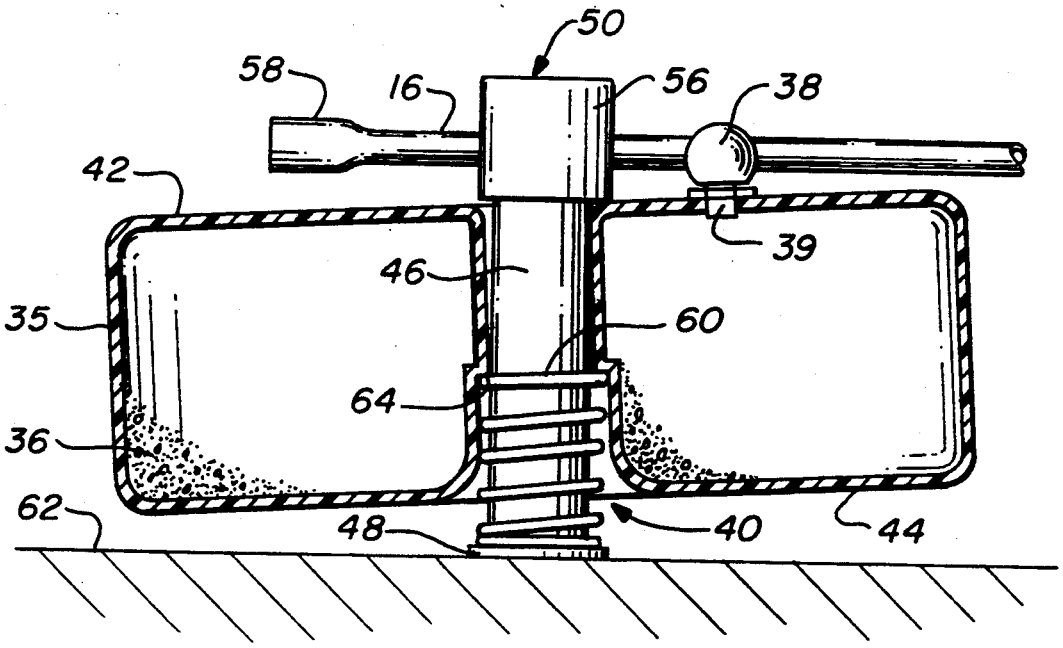
FIG. 4 is an elevational view of an improperly filled anchor member.
Figure 5:
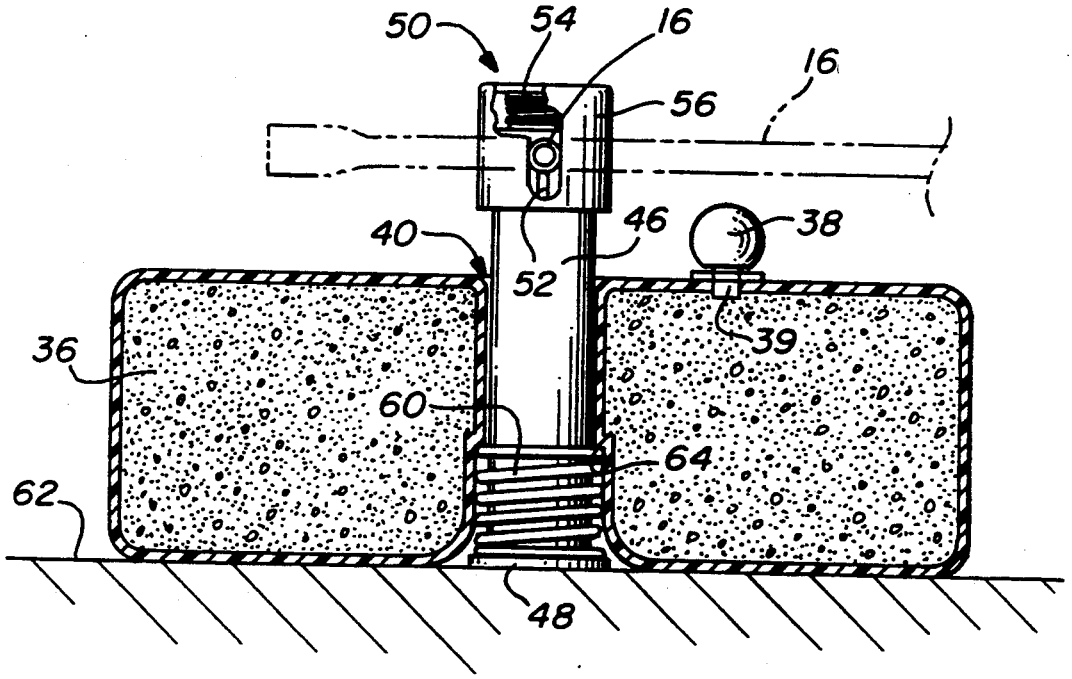
FIG. 5 is an elevational view of a properly filled anchor member.

Referring to FIGS. 4 and 5, central anchor member 14 is preferably formed of molded plastic and is essentially a hollow container 35. Central anchor member 14 is to be filled with a medium 36 such as sand, gravel, or water to provide enough weight to hold central anchor member 14 in place during use of infant walker 10. The sand, gravel, or water is inserted into central anchor member 14 by removing a fill cap 38 and then putting the material into container 35 through an inlet 39.

The container 35 includes structure defining an opening 40 through the container 35 from a top side 42 to a bottom side 44. An elongated central pivoting member 46 presenting opposed ends is contained within the container opening 40. The central pivoting member 46 includes a base portion 48 for resting against a floor or other surface at one of the opposed ends. An attachment arm holding device, shown generally at 50, is attached to central pivoting member 46 at the other opposed end, as shown in FIGS. 4 and 5.

As best seen in FIG. 5, the attachment arm holding device 50 is a spring loaded member through which attachment arm 16 passes. The holding device 50 includes an interference pin 52 which contacts attachment arm 16 and holds it in place through the force of a spring 54 pushing against holding device 50. When external housing 56 is depressed by a user attachment arm 16 can be moved relative to holding device 50 to change the radius of the infant carriage unit 12 path. Preferably, the attachment arm 16 is approximately 2½ feet in length thereby providing a maximum walking path for an infant of approximately 5 feet in diameter.

As shown in FIG. 4, the attachment arm 16 preferably includes a flanged end 58 to prevent the arm 16 from being totally removed from the central pivoting member 46. This is another safety feature which discourages people from attempting to use the infant carriage unit 12 without having the carriage unit 12 attached to the anchor member 14. As shown in FIG. 4, if the container 35 is insufficiently filled with weight providing material 36 a spring 60 which surrounds central pivoting member 46 causes the container 35 to be raised off a floor 62 by contact with a flange 64 contained within the opening 40. When the container 35 is raised off the floor 62 the fill cap 38 interferes with the rotation of the attachment arm 16, as shown in FIG. 4, and thus helps to ensure the proper use of the infant walker 10.

If, as shown in FIG. 5, the container 35 is filled, the weight of the sand or other material 36 causes container 35 to compress spring 60 allowing the bottom 44 to rest against floor 62. When container 35 rests on floor 62 this allows arm 16 to be rotated above and free of fill cap 38.

FIGS. 6–9 disclose an alternate embodiment of the infant walker, wherein a different anchor member 70, a pivoting member 72, and attachment arm 74 are disclosed.

Figure 6:
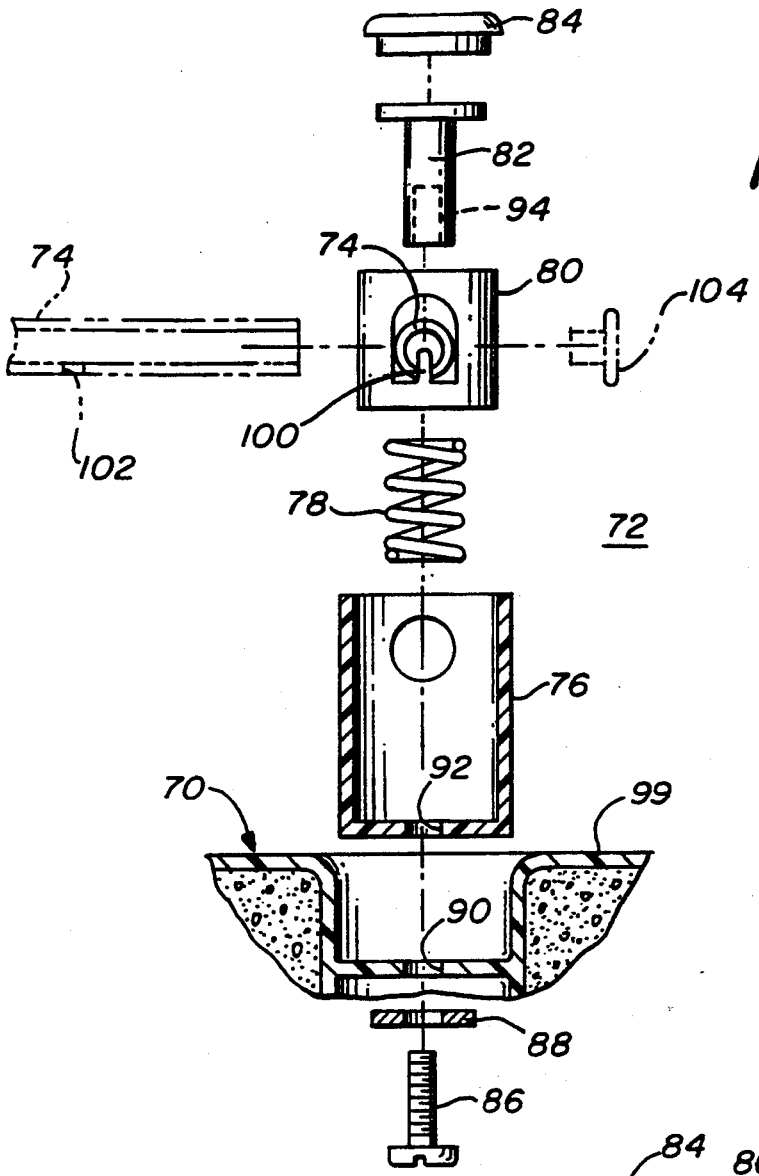
FIG. 6 is an exploded view of a pivoting member of an alternate embodiment of the invention.
Figure 7:
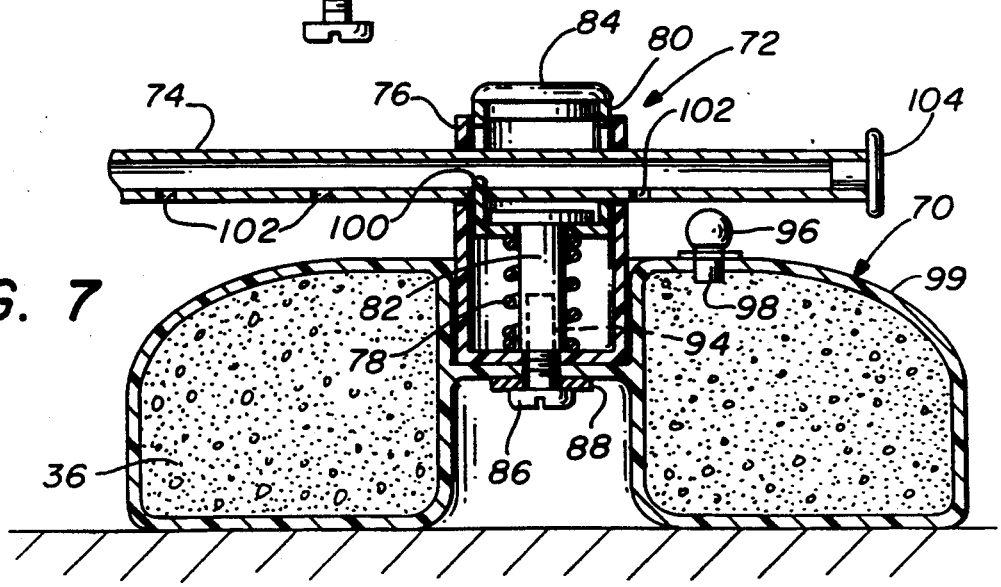
FIG. 7 is a cut away view of an assembled alternate embodiment of an anchor member, pivoting member, and attachment arm.

Referring to FIG. 6, pivoting member 72 is shown in exploded form and includes a push button tube 76, a spring 78, push button housing 80, stem 82, and cap 84. Stem 82 is slidably engaged within housing 80 and cap 84 encloses housing 80. As best seen in FIG. 7, spring 78 surrounds stem 82 and the pivoting member 72 is rotatably coupled to anchor member 70 by a screw 86 and washer 88. Screw 86 passes through washer 88, whole 90 in anchor member 70, a hole 92 in push button tube 76 and is threadably engaged with stem 82 at orifice 94.

Anchor member 70, includes a fill cap 96 and inlet 98 integral to housing 99 through which sand 36 is preferably poured to provide sufficient weight to prevent an infant from walker in other than a circular path about anchor member 70.

Push button housing 80 includes a tooth or pin 100 which fits within a plurality of holes 102 in attachment arm 74. In operation, a user, in order to change the radius of the infant walker path, pushes against cap 84 to force pin 100 below arm 74 and then slides arm 74 to a desired position to engage another hole 102. Preferably, arm 74 is passed through tube 76 and housing 80 and cap 104 is attached to arm 74 to prevent the removal of arm 74 from pivoting member 72. This end cap 104 helps to ensure the proper use of the infant walker by keeping arm 74 attached to anchor member 70.

Figure 8:
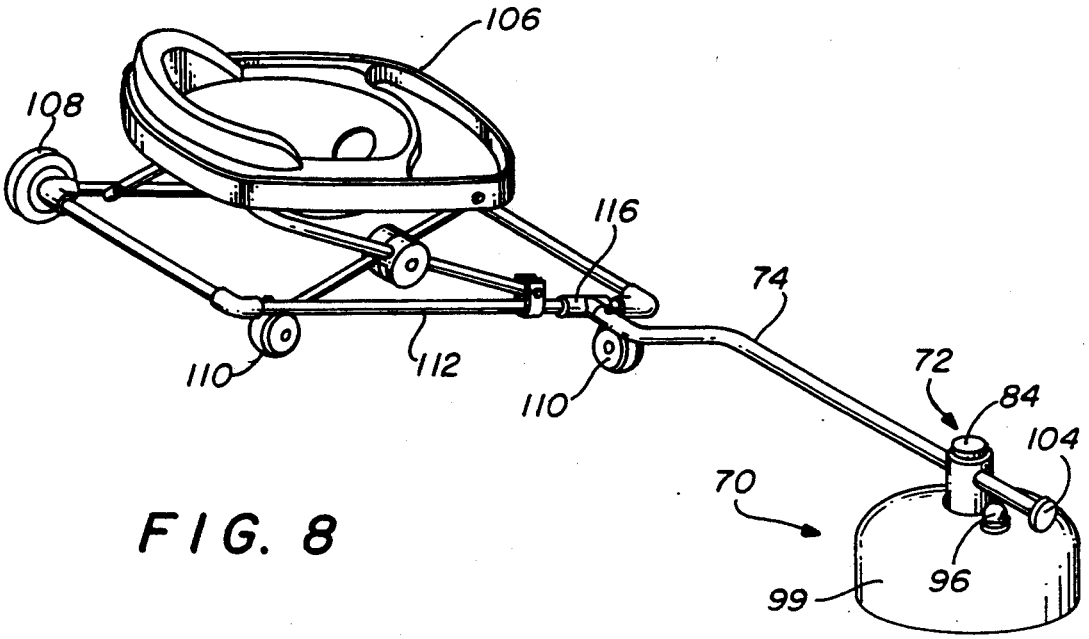
FIG. 8 is a perspective view of an alternate embodiment of an infant walker.
Figure 9:
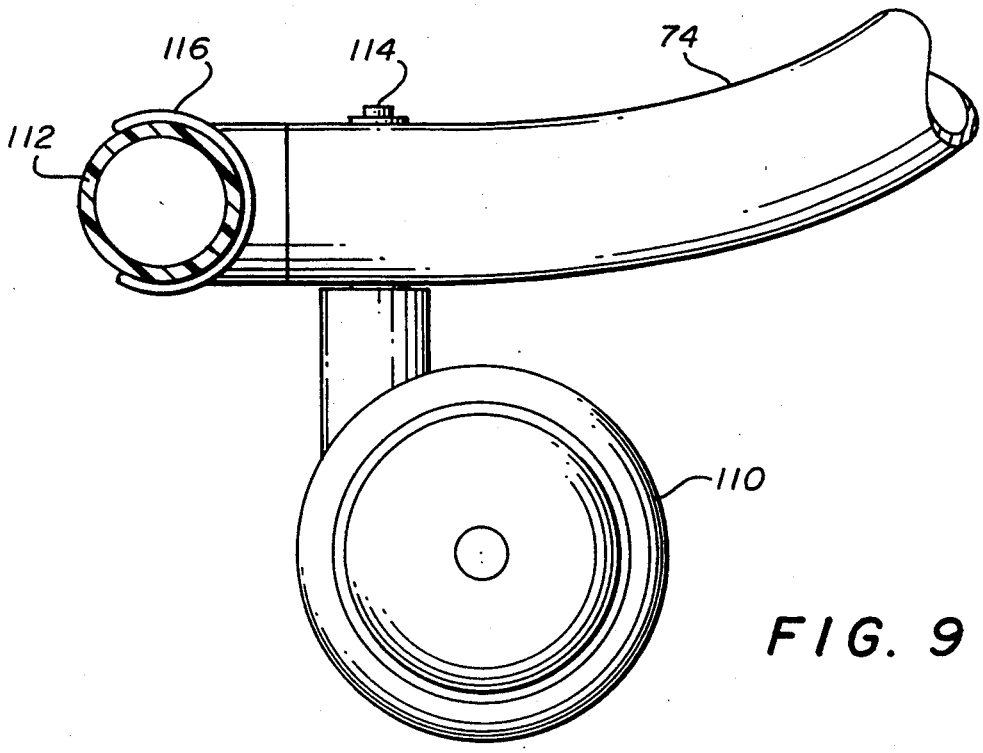
FIG. 9 is a fragmentary view of an attachment arm of the alternate embodiment of FIG. 8.

A further safety feature of this alternate embodiment is shown in FIGS. 8 and 9. An infant walker 106, is very similar to walker 10 and includes fixed wheels 108 identical to wheels 28 and casters 110 identical to casters 34 except one of casters 110 is connected to attachment arm 74 rather than to base frame 112. By placing one of casters 110 on attachment arm 74 infant walker 106 is essentially inoperable without arm 74 and anchor member 70 because walker 106 will be unstable with only three wheels. Therefore, the safe use of walker 106 is greatly increased. Caster 110 is pivotally connected to arm 74 and held to arm 74 by a palnut 114. To attach arm 74 to base frame 112 a resilient C-shaped member 116 is connected to arm 74, as shown in FIG. 9. Member 116 is connected and disconnected to frame 112 by simply pushing or pulling member 116 onto or away from frame 112.

As those skilled in the art will appreciate, it is noted that substitutions may be made for the preferred embodiment and equivalents employed herein without departing from the scope of the present invention as recited in the claims. For example, other pivoting means could be used and the anchor member 14 could be formed of a solid, sufficiently heavy material to ensure a stable infant walker.

We claim:

1. An infant walker comprising an infant carriage unit in which an infant is placed to walk, a central anchor member including a central pivoting member, and an attachment arm connected to said infant carriage unit and releasably attached to said central pivoting member for allowing an infant to walk only in a path about said anchor member, said central anchor member including:

an essentially hollow container for containing a medium to provide weight to allow an infant to walk only in a path about said central anchor member, said container presenting structure defining an opening through said container from a top side to a bottom side thereof;

a removable fill cap attached to said container for providing access to said container for filling said container with said weight providing medium;

an elongated central pivoting member presenting opposed ends contained within said container opening, said central pivoting member having a base portion for resting against a floor at one of the opposed ends;

an attachment arm holding device at the other of said central pivoting member opposed end for holding said attachment arm therein, wherein at least said holding device extends beyond the container top side; and a spring member surrounding said central pivoting member and disposed between the base portion and a flange formed within said container opening such that said spring member causes said container to be raised off of a floor when said container is not sufficiently filled with a weight providing medium to compress said spring member and allow said container to rest on the floor.

2. The walker of claim 1 wherein said container is formed of molded plastic.

3. The walker of claim 1, said fill cap being located on the top side of said container such that said fill cap contacts said attachment arm during rotation thereof when said container is not sufficiently filled.

4. An anchor apparatus for attachment to an infant walker, said anchor apparatus comprising a central anchor member including a central pivoting member and an elongated attachment arm presenting two ends wherein one of said ends includes means for attachment to an infant walker and wherein said attachment arm is releasably attached to said central pivoting member for restricting the movement of the infant walker to an essentially circular path about said anchor apparatus, said central anchor member including:

an essentially hollow container for containing a medium to provide weight to allow an infant to walk only in a path about said central anchor member, said container presenting structuring defining an opening through said container from a top side to a bottom side thereof;

a removable fill cap attached to said container for providing access to said container for filling said container with said weight providing medium;

an elongated central pivoting member presenting opposed ends contained within said container opening, said central pivoting member having a base portion for resting against a floor at one of the opposed ends;

an attachment arm holding device at the other of said central pivoting member opposed end for holding said attachment arm therein, wherein at least said holding device extends beyond the container top side; and a spring member surrounding said central pivoting member and disposed between the base portion and a flange formed within said container opening such that said spring member causes said container to be raised off of a floor when said container is not sufficiently filled with a weight providing medium to compress said spring member and allow said container to rest on the floor.

5. The anchor apparatus of claim 4 wherein said container is formed of molded plastic.

6. An infant walker comprising:

an infant carriage unit in which an infant is placed to walk;

an elongated attachment arm connected to said infant carriage unit at one end thereof;

an essentially hollow container for containing a medium to provide weight to anchor said container, said container presenting structure defining an opening through said container from a top side to a bottom side thereof;

a removable fill cap attached to said container for providing access to said container for filling said container with said weight providing medium;

an elongated central pivoting member presenting opposed ends contained within said container opening, said central pivoting member having a base portion at one of the opposed ends for resting against a walking surface;

an attachment arm holding device at the other of said central pivoting member opposed ends for holding said attachment arm therein, wherein at least said holding device extends beyond the container top side such that an infant can only walk in a circular path about said container; and a spring member surrounding said central pivot member and disposed between the base portion and a flange formed within said container opening such that said spring member causes said container to be raised off a surface when said container is not sufficiently filled with the weight providing medium to compress said spring member and allow said container to rest on the surface, wherein when said container is not sufficiently filled said attachment arm contacts said fill cap when an infant attempts to walk in said infant carriage unit thereby interfering with the operation of said infant walker.

7. The infant walker of claim 6, further including:

a base frame member wherein said attachment arm is pivotally connected to a portion thereof;

a first set of wheels fixedly attached to said base frame for restricting movement of said infant carriage to a circular path; and a second set of wheels for providing support to said infant carriage wherein said second wheel set is pivotally attached to said base frame.

8. The infant walker of claim 7, said attachment arm including one of said second set of wheels connected thereto and further including connection means for connecting said attachment arm to said infant carriage unit wherein said wheel connected to said attachment arm contacts a walking surface and provides support to said infant carriage unit.

9. The walker of claim 8 wherein said connection means includes a resilient member releasably engageable with said base frame member.

10. The infant walker of claim 7 wherein said base frame is essentially square in shape and said first set of wheels are fixedly attached to said base frame at approximately equal and opposite angles relative to each other and a side of said base frame such that said wheels lie in a common arcuate path.

* * * * *